United States Patent [19]

Markowski et al.

[11] 4,445,338

[45] May 1, 1984

[54] SWIRLER ASSEMBLY FOR A VORBIX AUGMENTOR

[75] Inventors: Stanley J. Markowski, East Hartford, Conn.; Richard S. Reilly, Lake Park, Fla.

[73] Assignee: The United States of America as represented by the Secretary of the Navy, Washington, D.C.

[21] Appl. No.: 314,285

[22] Filed: Oct. 23, 1981

[51] Int. Cl.[3] ..... F02G 1/00; F02K 1/38

[52] U.S. Cl. ..... 60/748; 60/751; 60/262

[58] Field of Search ..... 60/748, 751, 262; 239/472

[56] References Cited

U.S. PATENT DOCUMENTS

| | | | |
|---|---|---|---|
| 2,565,308 | 1/1945 | Hottell | 60/749 |
| 2,999,672 | 4/1958 | Harshman | 366/262 |
| 3,525,474 | 12/1968 | Von Ohain | 239/265.17 |
| 3,879,939 | 4/1975 | Markowski | 60/751 |
| 3,899,884 | 8/1975 | Ekstedt | 60/734 |
| 3,937,008 | 2/1976 | Markowski et al. | 60/39.06 |
| 3,974,646 | 8/1976 | Markowski et al. | 60/737 |
| 4,145,879 | 3/1979 | Markowski | 60/261 |
| 4,145,880 | 3/1979 | Markowski | 60/262 |
| 4,187,674 | 2/1980 | Richardson | 60/748 |
| 4,271,674 | 6/1981 | Marshall | 60/737 |
| 4,373,342 | 2/1983 | Willis et al. | 60/748 |

*Primary Examiner*—Louis J. Casaregola
*Assistant Examiner*—Timothy S. Thorpe
*Attorney, Agent, or Firm*—R. F. Beers; F. I. Gray

[57] ABSTRACT

An improved swirler assembly prevents flow separation in the diffuser section. An annular swirling layer of air surrounds a linear jet with mixing occurring between these air flows prior to the diffuser section. A center tube through the swirler section provides the linear jet which mixes with the swirler flow in a mixing area prior to the diffuser section.

4 Claims, 4 Drawing Figures

SWIRLER ASSEMBLY FOR A VORBIX AUGMENTOR

BACKGROUND OF THE INVENTION

1. Field of the Invention

The present invention relates to vortex burning and mixing (VORBIX) augmentors for aircraft engines, and more particularly to an improved swirler assembly for a VORBIX augmentor.

2. Description of the Prior Art There are two primary components to a VORBIX augmentor: a pilot including primary and secondary fuel systems, and a vortex generation section. As shown in co-pending patent application Ser. No. 314,161 entitled "An Augmented Combustion Chamber Using VORBIX Principle with Core Stream Swirl", filed Oct. 23, 1981 by Richard S. Reilly et al, the vortex generation section has a mixer at the end of the pilot and a swirler assembly which swirls the fan stream to provide mixing with the pilot flow and the swirling core stream. However, burn-out was experienced with the prior art swirler assembly where it partially intercepted a layer of the turbine discharge swirling air. This burn-out is attributed to flow separation in the diffuser section of the swirler assembly. The reverse flow brings back into the diffuser section hot vaporized fuel that burns and damages the internal portions of the swirler assembly.

SUMMARY OF THE INVENTION

Accordingly, the present invention provides an improved swirler assembly for a VORBIX augmentor which prevents flow separation in the diffuser section. An annular swirling layer of air surrounds a linear jet with mixing occurring between these air flows prior to the diffuser section to prevent flow separation in the diffuser section. A center tube through the swirler section provides the linear jet which mixes with the swirler flow in a mixing area prior to the diffuser section.

Therefore, it is an object of the present invention to provide a swirler assembly for a VORBIX augmentor which eliminates burn-out due to flow separation in the diffuser section.

Another object of the present invention is to provide a swirl assembly for a VORBIX augmentor which has an annular swirling layer of air surrounding a linear jet with mixing between these air streams prior to the diffuser section.

Other objects, advantages and novel features of the present invention will be apparent from the following detailed description when read in conjunction with the appended claims and attached drawing.

DESCRIPTION OF THE PREFERRED EMBODIMENT

Figure 1:
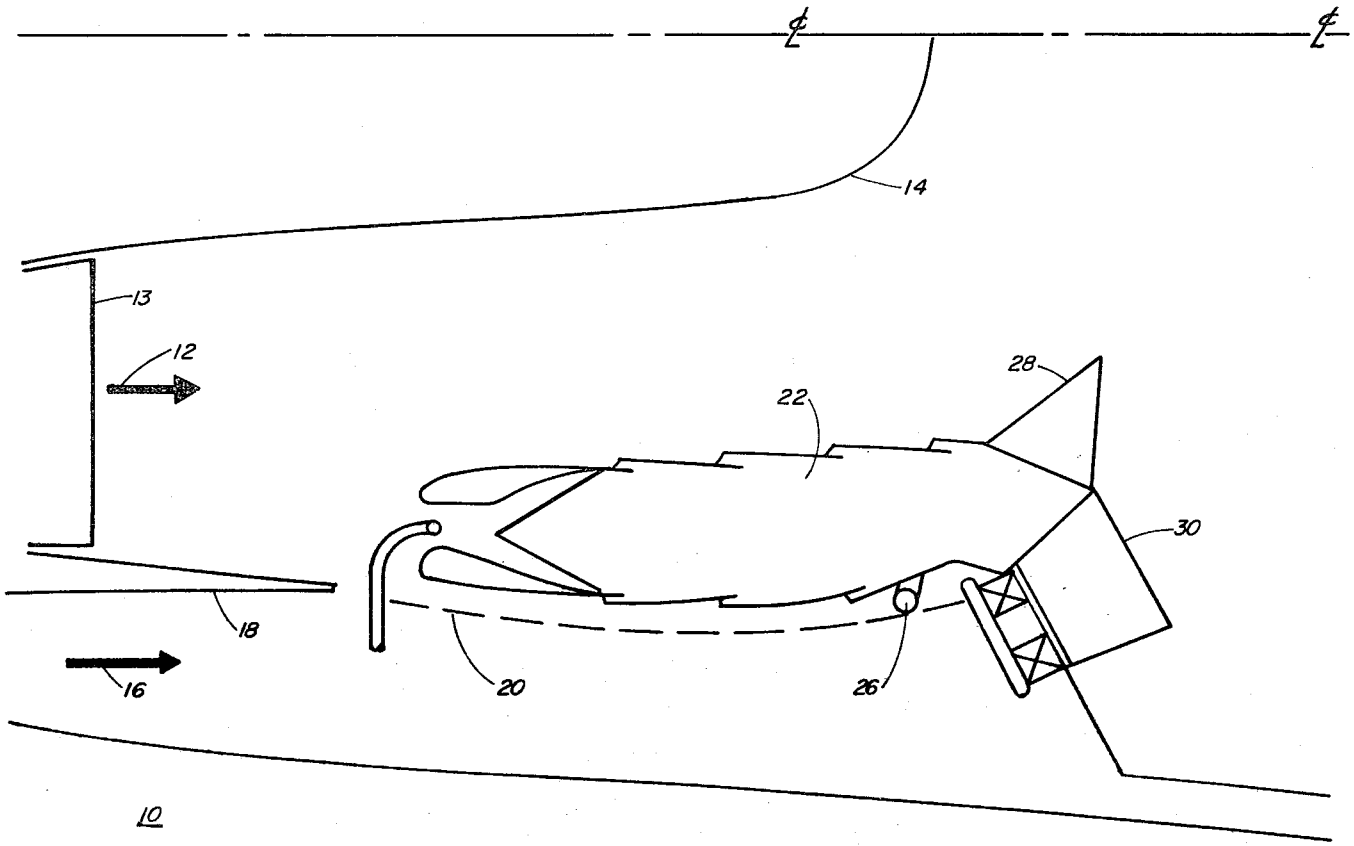
FIG. 1 is a cross-sectional schematic view of a VORBIX augmentor with a swirler assembly.

Referring now to FIG. 1 a VORBIX augmentor 10 is shown. The turbine discharge air or core stream flow 12 from the turbine (not shown) flows across a turbine exit guide vane 13 and along a center body 14, and is separated from a fan stream flow 16 by a splitter 18 which creates a fan/core stream interface 20. A pilot 22 is located in the core stream flow 12 with a primary 24 and a secondary 26 fuel injection system. A mixer 28 is situated at the exit of the pilot 22. A swirler assembly 30 also is situated at the exit of the pilot in the fan stream flow 16. The swirler assembly 30 together with the mixer 28 produce mixing of the pilot flow with the core stream flow 12 and the fan stream flow 16 for auto-ignition.

Figure 2:
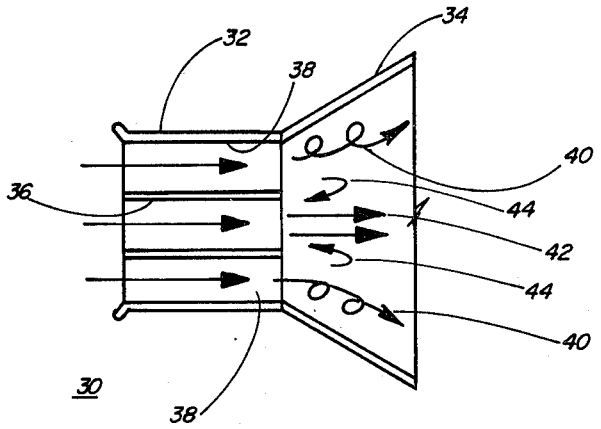
FIG. 2 (PRIOR ART)
FIG. 2 is a cross-sectional schematic view of a prior art swirler assembly.

FIG. 2 shows a prior art swirler assembly 30 having a swirler section 32 and a diffuser section 34. A center tube 36 runs the length of the swirler section 32 with swirler vanes 38 in the annular region around the center tube to provide the swirling action. Within the diffuser section 34 between the swirling flow 40 and the axial flow 42 is a separation region 44 where the reverse flow brings back hot vaporized fuel into the diffuser section to produce burn-out.

Figure 3:
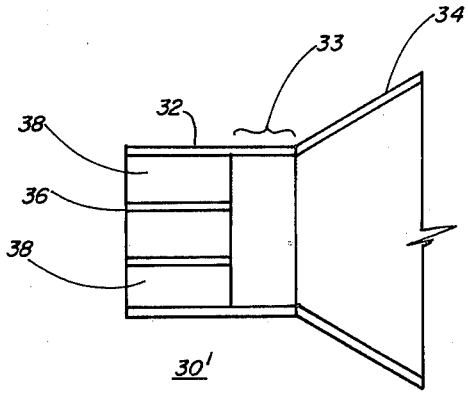
FIG. 3 is a cross-sectional schematic view of one embodiment of a swirler assembly according to the present invention.

The first embodiment as shown in FIG. 3 provides increased interface mixing in a swirler assembly 30' prior to the diffuser section 34 by using a constant area mixing section 33 between the swirler section 32 and the diffuser section.

Figure 4:
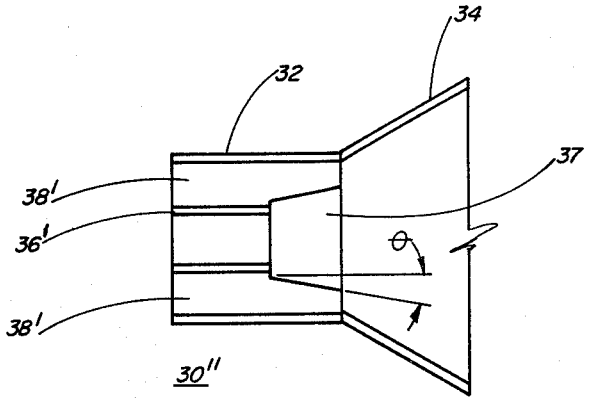
FIG. 4 is a cross-sectional schematic view of a second embodiment of a swirler assembly according to the present invention.

In a second embodiment a swirler assembly 30'' has a cut back center tube 36' as shown in FIG. 4 to expose the swirler vanes 38' and form a high rate mixing area 37. The swirler vanes 38' are modified by tapering the ends from the center tube 36' to the diffuser section 34 at an angle $\theta$. The cut-back center tube 36' not only allows some constant area mixing, but by virtue of the exposed swirler vanes 38' tin-flow vortices are formed to augment the interface mixing rate. The angle $\theta$ is determined so as to optimize the mixing rate. Additionally the swirler assemblies 30',30'' may be cocked so that the yaw angle with the swirling core stream 12 is reduced.

Thus, the present invention provides a swirler assembly for a VORBIX augmentor which produces mixing between the swirling flow and the linear flow prior to the diffuser section to prevent burn-out due to flow separation.

What is claimed is:

1. A swirler assembly for a VORBIX augmentor comprising:

a swirler section having means for generating a swirling air flow and a linear air flow;

a diffuser section section; and a constant area mixing section connected at one end to the output of said swirler section and at the other end to the furthermost upstream end of said diffuser section wherein said airflows are intermixed prior to entering said diffuser section.

2. A swirler assembly as recited in claim 1 wherein said generating means comprises:

a center tube within said swirler section to form said linear air flow; and a plurality of swirler vanes in the annular region about said center tube to form said swirling air flow.

3. A swirler assembly as recited in claim 2 wherein said mixing section comprises a mixing area formed by cutting back said center tube, said swirler vanes extending to said diffuser section so the tips of said swirler vanes are exposed.

4. A swirler assembly for a VORBIX augmentor comprising:

a swirler section having a center tube to generate a linear air flow and a plurality of swirler vanes in the annular region about said center tube to generate a swirling air flow;

a diffuser section;

a mixing section situated contiguously between said swirler section and said diffuser section to provide intermixing between said air flows prior to said diffuser section, said mixing section being formed by cutting back said center tube such that the tips of said swirler vanes extending to said diffuser section are exposed.

* * * * *